US006225765B1

(12) United States Patent
Yatsu et al.

(10) Patent No.: US 6,225,765 B1
(45) Date of Patent: May 1, 2001

(54) COLOR CATHODE RAY TUBE WITH A REDUCED DYNAMIC FOCUS VOLTAGE FOR AN ELECTROSTATIC QUADRUPOLE LENS THEREOF

(75) Inventors: Yasuharu Yatsu; Tomoki Nakamura; Shoji Shirai, all of Mobara (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/283,214

(22) Filed: Apr. 1, 1999

(30) Foreign Application Priority Data

Apr. 10, 1998 (JP) ..... 10-099408

(51) Int. Cl.[7] ..... G09G 1/04

(52) U.S. Cl. ..... 315/382; 313/414; 313/415; 313/467

(58) Field of Search ..... 315/382, 14, 15, 315/399; 313/409, 413, 414, 415, 467, 477 R

(56) References Cited

U.S. PATENT DOCUMENTS 4,887,009 * 12/1989 Bloom et al. ..... 315/382
5,055,749 * 10/1991 Chen et al. ..... 315/382
5,677,591 * 10/1997 Toujou et al. ..... 313/414
5,739,631 * 4/1998 Tojyou et al. ..... 315/382
5,814,930 * 9/1998 Watanabe et al. ..... 313/414
5,828,191 * 10/1998 Shirai et al. ..... 315/382
5,936,337 * 8/1999 Toujou et al. ..... 315/15
5,936,338 * 8/1999 Takahashi ..... 313/414
6,025,674 * 2/2000 Tojyou et al. ..... 313/414

* cited by examiner

*Primary Examiner*—Don Wong
*Assistant Examiner*—Thuy Vinh Tran
(74) *Attorney, Agent, or Firm*—Antonelli, Terry, Stout & Kraus, LLP

(57) ABSTRACT

A color cathode ray tube includes a phosphor screen, cathodes, a G1 electrode, a G2 electrode, a G4 electrode, a G5 electrode and an anode for focusing the electron beams on the phosphor screen. The G5 electrode is divided into plural sub-electrodes arranged to be supplied alternately with a first focus voltage and a second focus voltage, at least one electrostatic quadrupole lens is formed between two of the sub-electrodes supplied with the first and second focus voltages, respectively, at least one lens for correcting curvature of the image field is formed between two of the sub-electrodes supplied with the first and second focus voltages, respectively. The G4 electrode, the G5 electrode and the phosphor screen satisfy following inequalities: $0.0625 \times L$ (mm)$\leqq B-20A/(3\phi) \leqq 22.00$ mm, L(mm)$\leqq 352$ mm, where A (mm) is an axial length of the G4 electrode, $\phi$(mm) is an average of horizontal and vertical diameters of a center electron beam aperture in the G4 electrode, B(mm) is an axial length from a cathode side and to a phosphor screen side end of the G5 electrode, and L(mm) is an axial distance from the phosphor screen side end of the G5 electrode to a center of the phosphor screen.

16 Claims, 7 Drawing Sheets

COLOR CATHODE RAY TUBE WITH A REDUCED DYNAMIC FOCUS VOLTAGE FOR AN ELECTROSTATIC QUADRUPOLE LENS THEREOF

BACKGROUND OF THE INVENTION

The present invention relates to a color cathode ray tube, and particularly to a color cathode ray tube having a three beam in-line, dynamic focus type electron gun capable of providing good focus characteristics over the entire screen area and good display contrast with a reduced dynamic focus voltage for its electrostatic quadrupole lens.

Color cathode ray tubes having an in-line type electron gun for use in TV receivers or display monitors have a phosphor screen formed on the inner surface of a faceplate of its panel portion, a shadow mask closely spaced from the phosphor screen within the panel portion, a deflection yoke mounted around its funnel portion, and an in-line type electron gun housed in its neck portion. The in-line type electron gun includes three cathodes arranged in line, and at least the first grid (G1) electrode, the second grid (G2) electrode, the third grid (G3) electrode and an anode, and projects three electron beams toward the phosphor screen.

To obtain good display image at the periphery of the phosphor screen as well as the center of the phosphor screen, that is, uniform resolution over the entire phosphor screen by using a color cathode ray tube having an in-line type electron gun, it is known to employ an electron gun of the dynamic focus type in which an electrostatic quadrupole lens is formed between two adjacent ones among electrodes of the in-line type electron gun and one of the two is supplied with a fixed focus voltage and the other of the two is supplied with a fixed focus voltage superposed with a dynamic voltage varying with deflection of the electron beams.

FIG. 4 is a cross-sectional view of a prior color cathode ray tube employing an in-line type electron gun of the dynamic focus type (hereinafter referred to as a DF type in-line electron gun).

In FIG. 4, reference numeral 41 denotes a panel portion, 41F is a faceplate, 42 is a neck portion, 43 is a funnel portion, 44 is a phosphor screen, 45 is a shadow mask, 46 is an internal conductive coating, 47 is a DF type in-line electron gun, 48 is a deflection yoke.

A grid electrode occupying the nth position counting from a cathode is called a grid n electrode in this specification.

A grid occupying the nth position counting from a cathode is called a Gn in this specification.

In the DF type in-line electron gun 47, reference numerals $\mathbf{50}_1$, $\mathbf{50}_2$ and $\mathbf{50}_3$ denote cathodes, 51 is a G1 electrode, 52 is a G2 electrode, 53 is a G3 electrode, 54 is a G4 electrode, 55(1) is a first G5 sub-electrode, 55(2) is a second G5 sub-electrode, 56 is a G6 electrode (an anode), 57 is a shield cup, 58 are vertical electrode pieces, and 59 are horizontal electrode pieces.

The glass bulb of the color cathode ray tube comprises a panel portion 41, a neck portion 42 and a funnel portion 43. The panel portion 41 is provided with the phosphor screen 44 coated on the inner surface of its faceplate 41F and the shadow mask 45 closely spaced from the phosphor screen 44 within the panel portion 41. The funnel portion 43 is provided with the internal conductive coating 46 in its inner surface and the deflection yoke 48 mounted on its the outer surface. The neck portion 42 houses the DF type in-line electron gun 47 therein.

The DF type in-line electron gun 47 comprises three cathodes $\mathbf{50}_1$, $\mathbf{50}_2$ and $\mathbf{50}_3$ arranged in line in a horizontal plane, and following the cathodes, the G1 electrode 51, the G2 electrode 52, the G3 electrode 53, the G4 electrode 54, the first G5 sub-electrode 55(1), the second G5 sub-electrode 55(2), the G6 electrode 56, the shield cup 57, arranged along the axis of the cathode ray tube in the order named. One center and two side electron beam apertures in each of the G1 electrode 51, the G2 electrode 52, the G3 electrode 53, the G4 electrode 54, the first G5 sub-electrode 55(1), the second G5 sub-electrode 55(2), the G6 electrode 56, and the shield cup 57 are aligned with center lines $O_2$, $O_1$ and $O_3$ of the cathodes $\mathbf{50}_2$, $\mathbf{50}_1$, and $\mathbf{50}_3$, respectively.

In the G6 electrode 56, the center line of the center electron beam aperture is aligned with the center line $O_2$ of the corresponding cathode $\mathbf{50}_2$, and the respective center lines of the two side electron beam apertures are slightly displaced outwardly with respect to the center lines $O_1$ and $O_3$ of the corresponding cathodes $\mathbf{50}_1$ and $\mathbf{50}_3$, respectively. The first G5 sub-electrode 55(1) is provided with the vertical electrode pieces 58 sandwiching horizontally each of the three electron beam apertures in its end facing the second G5 sub-electrode 55(2), and the second G5 sub-electrode 55(2) is provided with a pair of the horizontal electrode pieces 59 sandwiching vertically the three electron beam apertures in common in its end facing the first G5 sub-electrode 55(1). The vertical electrode pieces 58 and the horizontal electrode pieces 59 form an electrostatic quadrupole lens between the first and second G5 sub-electrodes 55(1), 55(2).

In operation, the first G5 sub-electrode 55(1) is supplied with a fixed focus voltage, the second G5 sub-electrode 55(2) is supplied with a fixed focus voltage superposed with a dynamic voltage varying with deflection of the electron beams, and the G6 electrode 56 serving as an anode, the shield cup 57 and the internal conductive coating 46 are supplied with an accelerating voltage (an anode voltage).

In the prior art color cathode ray tube, three electron beams emitted from the three cathodes $\mathbf{50}_1$, $\mathbf{50}_2$, $\mathbf{50}_3$ of the DF type in-line electron gun 47 travel accelerated and focused along the respective center lines $O_1$, $O_2$, $O_3$ through the electron beam apertures in each of the G1 electrode 51, the G2 electrode 52, the G3 electrode 53, the G4 grid electrode 54, the first G5 sub-electrode 55(1), the second G5 sub-electrode 55(2), the G6 electrode 56, the shield cup 57, and are projected from the electron gun 47 toward the phosphor screen 44. The three electron beams projected from the electron gun 47 are properly deflected horizontally and vertically by the deflection yoke 48, then pass through an electron beam aperture in the shadow mask 45 and impinge upon the phosphor screen 44 to produce a desired image on the phosphor screen 44.

Color cathode ray tubes for use in color display monitors and the like usually employ a self-converging deflection yoke 48 of the type having both horizontal and vertical deflection windings wound in a saddle configuration (hereinafter referred to as the saddle/saddle type) to prevent magnetic fields generated by the deflection yoke 48 from radiating from the monitor to its outside.

The self-converging deflection yoke 48 increases deflection defocusing on the phosphor screen 44 due to the inherent non-uniformity in its deflection magnetic fields, deteriorates image resolution at the periphery of the phosphor screen 44 and therefore an electrostatic quadrupole lens is employed in the in-line type electron gun 47 with a dynamic focus voltage varying with deflection of the electron beams.

When the deflection of the electron beams is zero or very small, that is, when the electron beams scan the central portion of the phosphor screen 44, a dynamic voltage becomes zero or very small, a focus voltage applied to the first G5 sub-electrode 55(1) becomes equal or nearly equal to a focus voltage applied to the second G5 sub-electrode 55(2), the strength of the electrostatic quadrupole lens is weakened and consequently no astigmatism is produced in the electron beam spot at the center of the phosphor screen 44.

When the deflection of the electron beams is large, that is, when the electron beams scan the periphery of the phosphor screen 44, the dynamic voltage becomes large, the focus voltage applied to the second G5 sub-electrode 55(2) becomes higher than the focus voltage applied to the first G5 sub-electrode 55(1) and the strength of the electrostatic quadrupole lens becomes stronger to produce astigmatism of the electron beams deflected to the periphery of the phosphor screen 44. This astigmatism causes the shape of the beam spot on the phosphor screen to elongate its core portion vertically and to elongate its halo horizontally such that deflection defocusing caused by the self-converging deflection yoke 48 is canceled out and resolution at the periphery of the phosphor screen 44 is improved.

In a color cathode ray tube employing the prior art DF type in-line electron gun, a distance between its main lens and the periphery of the phosphor screen 44 is longer than that between its main lens and the center of the phosphor screen 44, and the electron beam focusing condition for the center of the phosphor screen 44 differs from that for the periphery of the phosphor screen 44 such that adjustment for the best beam focus at the center of the phosphor screen 44 degrades the beam focus and resolution at the periphery of the phosphor screen 44. If a correction lens for curvature of the image field is incorporated in the DF type in-line electron gun 47, when the electron beams are deflected to the periphery of the phosphor screen 44, a focus voltage applied to the second G5 sub-electrode 55(2) becomes higher, a difference between the focus voltage and an accelerating voltage (an anode voltage) applied to the G6 electrode 56 decreases and the strength of the focus lens weakens such that the focus point (the image point) of the electron beams is moved toward the phosphor screen 44, the electron beams deflected to the periphery of the screen 44 are focused on the phosphor screen 44 and deterioration in resolution at the periphery of the screen 44 is prevented. In this way, by using a dynamic voltage, the prior color cathode ray tube can correct curvature of the image field as well as astigmatism in electron beam spots.

The prior art color cathode ray tube corrects astigmatism in beam spot and curvature of the image field by applying a dynamic voltage to the second G5 sub-electrode 55(2) of an electrostatic quadrupole lens. If a color cathode ray tube for use in a color monitor or the like employs a deflection yoke 48, of a relatively wide deflection angle, 95° to 105°, for example, to reduce the depth of the monitor, a required dynamic voltage becomes a little too high for a color monitor due to its large deflection angle of the electron beams, and a distance between the main lens and the phosphor screen (hereinafter referred to as a lens-screen distance) becomes shorter such that the scanning electron beams and electron beam apertures in the shadow mask 45 interfere with each other and produce raster moire (horizontal spurious stripes) on the phosphor screen.

To solve the above problems in the DF type in-line electron gun, the present inventors previously proposed an electron gun satisfying the following inequalities to reduce the magnitude of a dynamic voltage and reduce appearance of raster moire (horizontal spurious stripes) on the phosphor screen:

$$0.06\times L(\text{mm}) \leqq B-20\times A/(3\phi) \leqq 19.0(\text{mm}),$$

and $$L \leqq 352(\text{mm})$$

where

A(mm) is an axial length of the G4 electrode, $\phi$(mm) is a diameter of an aperture in the G4 electrode, B(mm) is an axial length of the G5 electrode, and L(mm) is a distance between the end of the G5 electrode on its phosphor side and the phosphor screen.

When the proposed color cathode ray tube employs a dark tainted panel (light transmission of 38%, for example) for a faceplate of a panel portion to increase its display contrast ratio and it is operated to provide the display brightness equal to that of a color cathode ray tube employing a tainted panel (light transmission of 50%, for example), there arises a new problem that electron beam spots on the phosphor screen are enlarged.

For example, if the proposed color cathode ray tube employs a faceplate with its light transmission reduced by about 20% compared with that of a tainted panel by using a dark-tainted panel and by applying antistatic and antireflection coating on the dark-tainted panel if necessary, a beam current for each cathode has to be increased by about 30% to obtain a brightness equivalent to that of a color cathode ray tube employing the tainted panel and consequently its beam spot diameter is increased by about 10%.

SUMMARY OF THE INVENTION

The present invention solves the above problems, it is an object of the present invention to provide a color cathode ray tube capable of correcting astigmatism of electron beam spots and curvature of the image field, reducing the magnitude of a dynamic voltage even when it employs a wide-angle deflection yoke and reducing appearance of raster moire on the phosphor screen.

To accomplish the above object, in accordance with one embodiment of the present invention, there is provided a color cathode ray tube comprising an evacuated envelope comprising a panel portion, a neck portion, a funnel portion for connecting the panel portion and the neck portion, a phosphor screen formed on an inner surface of a faceplate of the panel portion, an in-line type electron gun housed in the neck portion, and a deflection yoke mounted around the funnel portion; the in-line type electron gun comprising an electron beam generating section having three in-line cathodes, a G1 electrode and a G2 electrode arranged in the order named for projecting three electron beams arranged approximately in parallel with each other in a horizontal plane toward the phosphor screen, and an electron beam focusing section comprising a G3 electrode, a G4 electrode, a G5 electrode and an anode arranged in the order named for focusing the three electron beams on the phosphor screen, wherein the G5 electrode comprises a plurality of sub-electrodes arranged to be supplied alternately with a first focus voltage and a second focus voltage, the first focus voltage being a first fixed voltage, the second focus voltage being a second fixed voltage superposed with a dynamic voltage varying with deflect ion of the three electron beams, at least one electrostatic quadrupole lens is formed between two of the plurality of sub-electrodes supplied alternately with the first focus voltage and the second focus voltage, at least one lens for correcting curvature of the image field is formed between two of the plurality of sub-electrodes supplied alternately with the first focus voltage and the second focus voltage, the G4 electrode, the G5 electrode and the phosphor screen satisfy following inequalities: $0.0625 \times L(mm) \leqq B-20A/(3\phi) \leqq 22.0$ mm, $L(mm) \leqq 352$ mm, where A(mm) is an axial length of the G4 electrode, $\phi$(mm) is an average of horizontal and vertical diameters of an electron beam aperture for a center electron beam of the three electron beams in the G4 electrode, B(mm) is an axial length measured from a cathode side end of the G5 electrode to a phosphor screen side end of the G5 electrode, and L(mm) is an axial distance from the phosphor screen side end of the G5 electrode to a center of the phosphor screen.

To accomplish the above object, in accordance with another embodiment of the present invention, there is provided a color cathode ray tube comprising an evacuated envelope comprising a panel portion, a neck portion, a funnel portion for connecting the panel portion and the neck portion, a phosphor screen formed on an inner surface of a faceplate of the panel portion, an in-line type electron gun housed in the neck portion, and a deflection yoke mounted around the funnel portion; the in-line type electron gun comprising an electron beam generating section having three in-line cathodes, a G1 electrode and a G2 electrode arranged in the order named for projecting three electron beams arranged approximately in parallel with each other in a horizontal plane toward the phosphor screen, and an electron beam focusing section comprising a G3 electrode, and an anode arranged in the order named for focusing the three electron beams on the phosphor screen, wherein the G3 electrode comprises a plurality of sub-electrodes arranged to be supplied alternately with a first focus voltage and a second focus voltage, the first focus voltage being a first fixed voltage, the second focus voltage being a second fixed voltage superposed with a dynamic voltage varying with deflection of the three electron beams, at least one electrostatic quadrupole lens is formed between two of the plurality of sub-electrodes supplied alternately with the first focus voltage and the second focus voltage, at least one lens for correcting curvature of the image field is formed between two of the plurality of sub-electrodes supplied alternately with the first focus voltage and the second focus voltage, the G3 electrode and the phosphor screen satisfy following inequalities: $0.0625 \times LA(mm) \leqq C \leqq 22.0$ mm, $LA(mm) \leqq 352$ mm, where C(mm) is an axial length measured from a cathode side end of the G3 electrode to a phosphor screen side end of the G3 electrode, and LA(mm) is an axial distance from the phosphor screen side end of the G3 electrode to a center of the phosphor screen.

BRIEF DESCRIPTION OF THE DRAWINGS

In the accompanying drawings, in which like reference numerals designate similar components throughout the figures, and in which.

DETAILED DESCRIPTION OF THE PREFERRED EMBODIMENTS

The present invention will now be described in detail with reference to the accompanying drawings.

Figure 1:
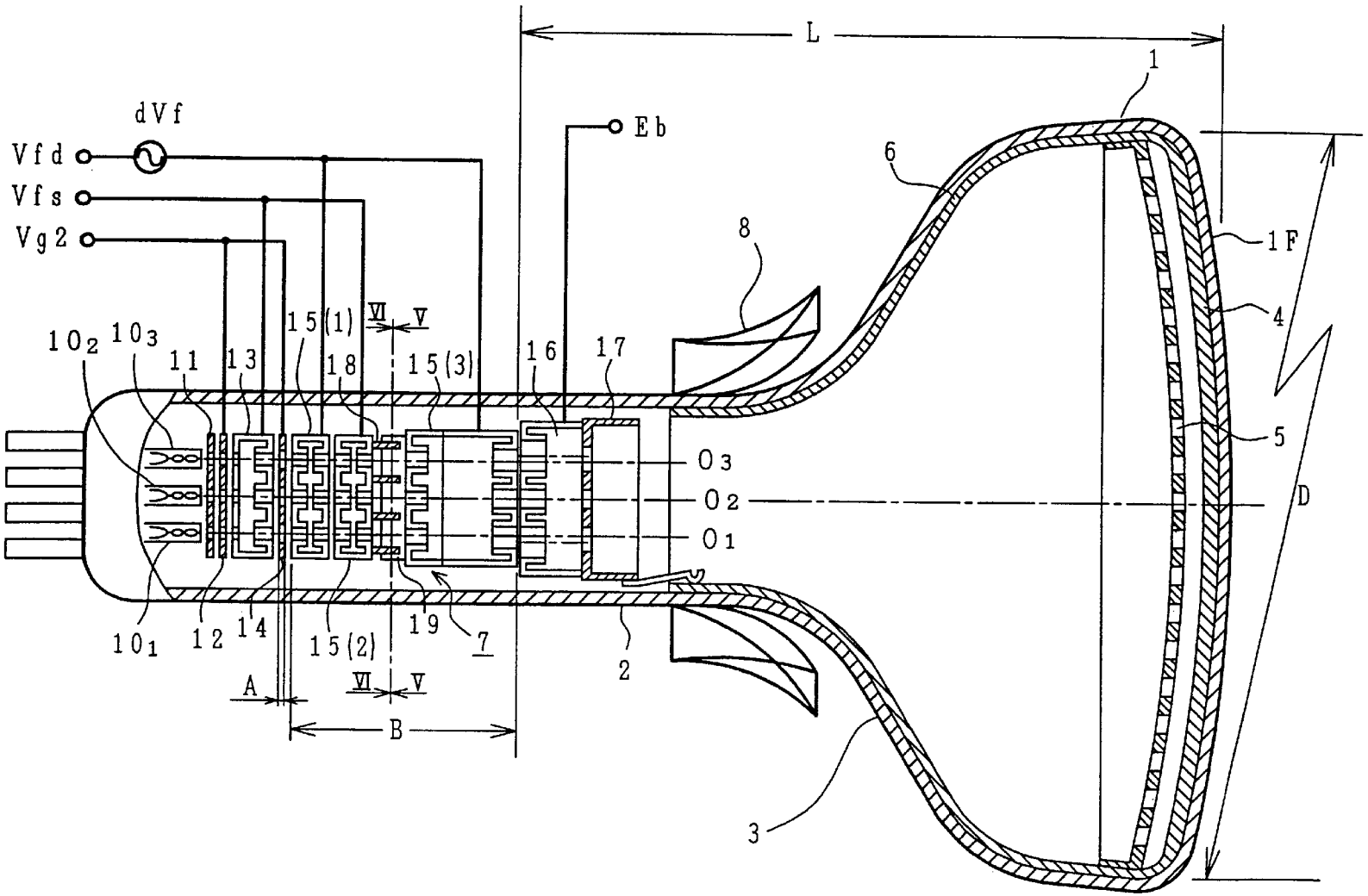
FIG. 1 is a horizontal cross-sectional view of a first embodiment of a color cathode ray tube in accordance with the present invention.

FIG. 1 is a horizontal cross-sectional view of a first embodiment of a color cathode ray tube in accordance with the present invention.

In FIG. 1, reference numeral 1 denotes a panel portion, 1F is a faceplate of the panel portion 1, 2 is a neck portion, 3 is a funnel portion, 4 is a phosphor screen, 5 is a shadow mask, 6 is an internal conductive coating, 7 is a DF type in-line electron gun, and 8 is a so-called saddle-saddle type deflection yoke having horizontal and vertical deflection windings wound in a saddle configuration for a maximum diagonal deflection angle of 100°.

In the DF type in-line electron gun 7, reference numeral $\mathbf{10}_1$ denotes a left-hand cathode, $\mathbf{10}_2$ is a center cathode, $\mathbf{10}_3$ is a right-hand cathode, 11 is the G1 electrode, 12 is the G2 electrode, 13 is the G3 electrode, 14 is the G4 electrode, 15(1) is a first G5 sub-electrode, 15(2) is a second G5 sub-electrode, 15(3) is a third G5 sub-electrode, 16 is the G6 electrode, 17 is a shield cup, 18 are vertical electrode pieces and 19 are horizontal electrode pieces. One sub-electrode may be comprised of one or more members.

The glass bulb of the color cathode ray tube comprises a panel portion 1 having a faceplate 1F, a small-diameter neck portion 2 and a generally frustum-shaped funnel portion 3 for connecting the panel portion 1 and the neck portion 2. A phosphor screen 4 is coated on the inner surface of the faceplate 1F and a shadow mash 5 is closely spaced from the phosphor screen 4 within the panel portion 1. An internal conductive coating 6 is coated on the inner surface of the funnel portion 3, a deflection yoke 8 is mounted around the funnel portion 3, and the DF type in-line electron gun 7 is housed in the neck portion 2.

The DF type in-line electron gun 7 comprises the left-hand cathode $\mathbf{10}_1$, the center cathode $\mathbf{10}_2$, and right-hand cathode $\mathbf{10}_3$ arranged in line in a horizontal plane, and following the cathodes, the G1 electrode 11, the G2 electrode 12, the G3 electrode 13, the first G5 sub-electrode 15(1), the second G5 sub-electrode 15(2), the third G5 sub-electrode 15(3), the fourth G5 sub-electrode 15(4), the G6 electrode 16, the shield cup 17, arranged along the axis of the cathode ray tube in the order named. Center lines of a left-hand beam aperture, a center beam aperture and a right-hand beam aperture in each of the G1 electrode 11, the G2 electrode 12, the G3 electrode 13, the G4 electrode 14, the first G5 sub-electrode 15(1), the second G5 sub-electrode 15(2), the third G5 sub-electrode 15(3), the phosphor-side end of the G6 electrode 16, and the shield cup 17 are aligned with center lines $O_1$, $O_2$ and $O_3$ of the cathodes $\mathbf{10}_1$, $\mathbf{10}_2$ and $\mathbf{10}_3$, respectively.

In the cathode-side end of the G6 electrode 16, the center line of the center electron beam aperture is aligned with the center line $O_2$ of the center cathode $\mathbf{10}_2$, and the center line of the left-hand electron beam aperture is slightly displaced outwardly with respect to the center line $O_1$ of the left-hand cathodes $\mathbf{10}_1$ and the center line of the right-hand electron beam aperture is slightly displaced outwardly with respect to the center line $O_3$ of the right-hand cathodes $\mathbf{10}_3$.

The following explains the structure of electrodes for forming the electrostatic quadrupole lens formed between the second G5 sub-electrode 15(2) and the third G5 sub-electrode 15(3).

Figure 5:
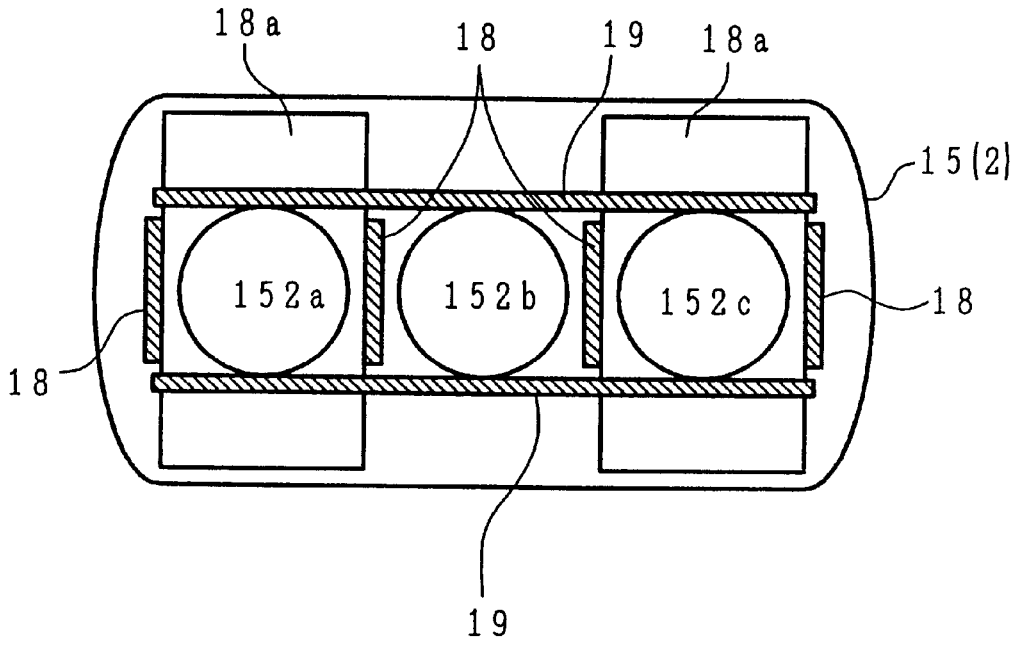
FIG. 5 is a cross-sectional view of a second G5 sub-electrode of FIG. 1 as viewed in the direction of arrows V—V in FIG. 1.
Figure 6:
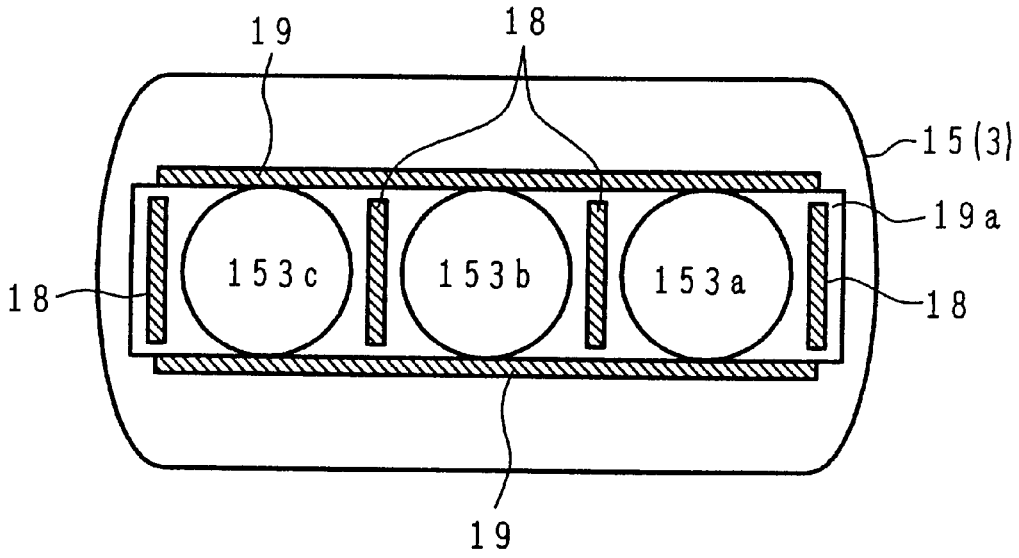
FIG. 6 is a cross-sectional view of a third G5 sub-electrode of FIG. 1 as viewed in the direction of arrows VI—VI in FIG. 1.

FIG. 5 is a cross-sectional view of the second G5 sub-electrode 15(2) of FIG. 1 as viewed in the direction of arrows V—V in FIG. 1, and FIG. 6 is a cross-sectional view of the third G5 sub-electrode 15(3) of FIG. 1 as viewed in the direction of arrows VI—VI in FIG. 1.

The second G5 sub-electrode 15(2) is provided with the vertical electrode pieces 18 sandwiching horizontally each of the three electron beam apertures 152*a*, 152*b*, 152*c* in its end facing the third G5 sub-electrode 15(3), and the third G5 sub-electrode 15(3) is provided with a pair of the horizontal electrode pieces 19 sandwiching vertically the three electron beam apertures 153*a*, 153*b*, 153*c* in common in its end facing the second G5 sub-electrode 15(2). The vertical electrode pieces 18 and the horizontal electrode pieces 19 form an electrostatic quadrupole lens between the second and third G5 sub-electrodes 15(2), 15(3).

In FIGS. 5 and 6, the reference numerals 18*a* and 19*a* denote baseplates for welding the vertical and horizontal electrode pieces to the second and third sub-electrodes, respectively.

The G1 electrode 11 is supplied with a voltage approximately equal to or near zero volt, the G2 electrode 12 and the G4 electrode 14 are supplied with a relatively low voltage Vg2 of about 400 to about 1000 volts, the G3 electrode 13 and the second G5 sub-electrode 15(2) are supplied with a fixed voltage Vfs of about 5 kV to about 10 kV, the first G5 sub-electrode 15(1) and the third G5 sub-electrode 15(3) are supplied with a focus voltage (Vfd+dVf) which is a fixed voltage Vfd superposed with a dynamic voltage dVf varying with deflection of the electron beams, and the G6 electrode 16, the shield cup 17 and the internal conductive coating 6 are supplied with an accelerating voltage (an anode voltage) Eb of about 20 kV to about 30 kV. Here the following relationship is satisfied:

$$Vfs \geqq Vfd+dVf.$$

The color cathode ray tube of the first embodiment operates as follows:

Three electron beams emitted from the three cathodes $\mathbf{10}_1$, $\mathbf{10}_2$, $\mathbf{10}_3$ of the DF type in-line electron gun 7 travel accelerated and focused along the respective center lines $O_1$, $O_2$, $O_3$ of the three cathodes through the electron beam apertures in each of the G1 electrode 11, the G2 electrode 12, the G3 electrode 13, the G4 electrode 14, the first, second and third G5 sub-electrodes 15(1), 15(2), 15(3), the G6 electrode 16 and the shield cup 17, and they are projected from the electron gun 47 toward the phosphor screen 4. The three electron beams projected from the electron gun 7 are properly deflected horizontally and vertically by the deflection yoke 18, then pass through an electron beam aperture in the shadow mask 5 and impinge upon the phosphor screen 4 to produce a desired image on the phosphor screen 4.

The vertical electrodes 18 attached to the second G5 sub-electrode 15(2) and the horizontal electrode pieces 19 attached to the third G5 sub-electrode 15(3) form an electrostatic quadrupole lens therebetween, and the third G5 sub-electrode 15(3) is supplied with the focus voltage (Vfd+dVf) containing the dynamic voltage dVf varying with deflection of the electron beams.

When the electron beams scan the central portion of the phosphor screen 4 with their deflection being zero or very small, the dynamic voltage dVf is zero or a very small positive value, and the focus voltage (Vfd+dVf) applied to the third G5 sub-electrode 15(3) is set to be lower than the focus voltage Vfs applied to the second G5 sub-electrode 15(2).

When the electron beams scan the periphery of the phosphor screen 4 with their deflection being large, the dynamic voltage is large, the focus voltage (Vfd+dVf) applied to the third G5 sub-electrode 15(3) approaches the focus voltage Vfs applied to the second G5 sub-electrode 15(2) and the electrostatic quadrupole lens functions to compress electron beam spots in a horizontal direction and to expand the electron beam spots in a vertical direction, at the periphery of phosphor screen 4. The astigmatism produced on the beam spot elongates its core portion vertically and elongates its halo horizontally such that it cancels out deflection defocusing caused by the self-converging deflection yoke 8 and it improves resolution at the periphery of the phosphor screen 4.

The above-mention e d deflection defocusing can be eliminated or reduced more effectively by making a main lens formed between the third G5 sub-electrode 15(3) and the G6 electrode 16 such that electron beams are focused more strongly in a horizontal direction than in a vertical direction. The deflection defocusing can also be eliminated or reduced effectively by forming a lens for focusing electron beams more strongly in a horizontal direction than in a vertical direction in a space between the G3 electrode 13 and the first G5 sub-electrode 15(1), or between the G2 electrode 12 and the G3 electrode 13.

In the electrostatic quadrupole lens of the DF type in-line electron gun 7 in which the first and third G5 sub-electrodes 15(1), 15(3) are supplied with the focus voltage (Vfd+dVf) containing the dynamic voltage dVf, when the electron beam scans the periphery of the phosphor screen 4, the focus voltage (Vfd+dVf) applied to the first and third G5 sub-electrode 15(1), 15(3) becomes higher, a difference between the focus voltage (Vfd+dVf) and the focus voltage Vfs applied to the second G5 sub-electrode 15(2) and a difference between the focus voltage (Vfd+dVf) and the accelerating voltage Eb applied to the G6 electrode 16 decrease and the strength of the lens formed between the first and second G5 sub-electrodes 15(1), 15(2) and the strength of the main lens formed between the third G5 sub-electrode 15(3) and the G6 electrode 16 decrease. As a result, the electron beam focus point (the image point) is moved toward the phosphor screen 4 such that the electron beam deflected to the periphery of the screen 4 is focused on the phosphor screen 4 and deterioration in resolution is prevented at the periphery of the phosphor screen 4.

In this way, the color cathode ray tube employing the DF type in-line electron gun 7 of the first embodiment forms two curvature-of-the-image-field correction lenses between the first and second G5 sub-electrodes 15(1), 15(2) and between the third G5 sub-electrode 15(3) and the G6 electrode 16, and one electrostatic quadrupole lens between the second and third G5 sub-electrodes 15(2), 15(3) by applying the focus voltage (Vfd+dVf) containing the dynamic voltage dVf to the first and third G5 sub-electrodes 15(1), 15(3), and corrects astigmatism of an electron beam spot and curvature of the image field.

Figure 2A:
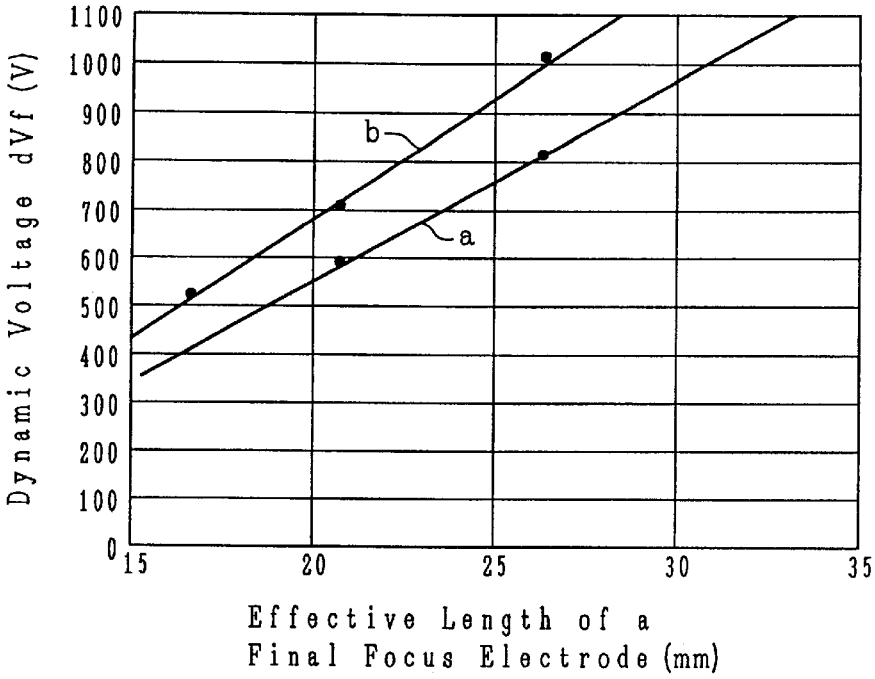
FIG. 2A is a graph showing a relationship between axial lengths of an electrode and dynamic voltages in a DF type in-line electron gun.
Figure 2B:
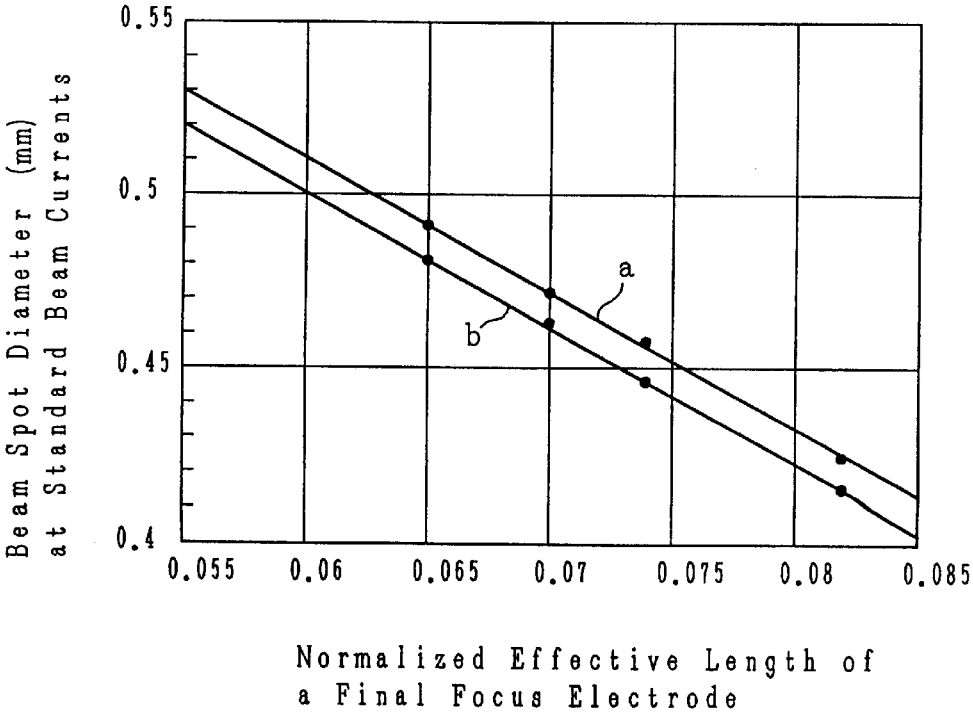
FIG. 2B is a graph showing a relationship between axial lengths of the electrode and electron beam spots in the DF type in-line electron gun.

FIGS. 2A and 2B are graphs showing a relationship between the dynamic voltages dVf and the lengths of the final focus electrode adjacent to the anode and that between the diameter of the beam spots and the lengths of the final focus electrode in the DF type in-line electron gun, respectively, FIG. 2A showing a relationship between axial lengths of the final focus electrode and dynamic voltages dVf and FIG. 2B showing a relationship between axial lengths of the final focus electrode and the diameter of electron beam spots.

The final focus electrode comprises three or more sub-electrodes supplied with one or more relatively high voltages.

In FIG. 2A, the dynamic voltages dVf are plotted as ordinates and the effective lengths of the final focus electrode as abscissas.

The effective length of the final focus electrode of the DF type in-line electron gun is defined as $\{B-20A/(3\phi)\}$ in FIG. 1, where B is an axial length a cathode-side end of the first G5 sub-electrode 15(1) to a phosphor-screen-side end of the fourth G5 sub-electrode 15(4), A is an axial length of the G4 electrode 14, $\phi$ is a diameter of an electron beam aperture for the center electron beam in the G4 electrode 14 and is an average of horizontal and vertical diameters of the center electron beam aperture in the G4 electrode if the center electron beam aperture is non-circular, such as elliptical, oval or rectangular.

As numerical examples, the axial length A of the G4 electrode is about 0.5 mm to about 1.0 mm, and the diameter $\phi$ of the electron beam aperture in the G4 electrode is about 4 mm.

The correction term $20A/(3\phi)$ represents the effect of the electron beam aperture in the G4 electrode 14 and a factor 20/3 is determined by experiment.

Line "a" indicates characteristics of a color cathode ray tube of the first embodiment using a 100° deflection yoke 8 and line "b" indicates characteristics of a color cathode ray tube with a 100° deflection yoke, previously proposed by the present inventors.

A lens-screen distance L is defined as a distance from the center of a phosphor screen to the anode-side end of a focus electrode for forming a final stage of a main lens in cooperation with the anode.

In FIG. 2B, the ordinates represent the diameters of the electron beam spots on the phosphor screen at the standard electron beam current and the abscissas represent the effective lengths of the final focus electrodes normalized by the lens-screen distance.

Line "a" indicates characteristics of a color cathode ray tube employing a dark-tainted panel (light transmission= approximately 38%) serving as a faceplate 1F of the panel portion, of the first embodiment, and line "b" indicates characteristics of a color cathode ray tube previously proposed by the present inventors and employing a tainted panel (light transmission=approximately 50%) serving as a faceplate.

The standard electron beam currents provide recommended brightness for respective screen sizes and are defined as $0.00115\ (\mu A/mm^2)\times D(mm)^2$, D being a useful diagonal dimension of the phosphor screen. As specific examples, the approximate standard electron beam currents are 200 $\mu$A, 250 $\mu$A, and 300 $\mu$A for useful diagonal screen dimensions D of 41 cm, 46 cm, and 51 cm, respectively.

FIG. 2A shows that, in a color cathode ray tube employing the DF type in-line electron gun, the dynamic voltages dVf is reduced with decrease in the effective length of the final focus electrode.

A relatively large screen size is more suited to a high-definition display monitor for use in graphic terminals or the like capable of displaying a high-resolution image of drawings as well as letters or characters than a small size screen used in personal computers are. But considering the desire to make a space occupied by a monitor as small as possible, as a measure to reduce the depth of the monitor, there is a tendency to reduce the axial length of a color cathode ray tube by increasing the deflection angle of electron beams in the color cathode ray tube. The increase of the deflection angle requires the increase in the magnitude of the above-explained dynamic voltage.

In the operation of the color cathode ray tube in the high definition display monitor, the frequency of the dynamic voltage is made higher because it is synchronized with the high-frequency deflection of electron beams. A limitation of breakdown voltage of transistors of dynamic voltage driver circuits of the monitor set can not provide a sufficiently high dynamic voltage to the color cathode ray tube of a required waveform.

Considering the capability of the presently-used dynamic focus circuit, the practical dynamic voltage dVf needs to be limited to 650 volts or a lower voltage.

For a color cathode ray tube employing a 100° deflection yoke 8, of the first embodiment, to limit the dynamic voltage dVf to 650 volts or a lower voltage, the following relationship is derived from the line "a" in FIG. 2A, $$\{B-20A/(3\phi)\}\leqq 22.0\ \text{mm}.$$

Incidentally, for the above-mentioned color cathode ray tube employing a 100° deflection yoke, previously proposed by the present inventors, to limit the dynamic voltage dVf to 650 volts or a lower voltage, the following relationship is derived from the line "b" in FIG. 2A, $$\{B-20A/(3\phi)\}\leqq 19.0\ \text{mm}.$$

FIG. 2B shows that, in both the color cathode ray tubes with the DF type in-line electron gun employing the dark-tainted panel and the tainted panel, respectively, the diameters of the electron beam spots on the phosphor screen at the standard electron beam current is increased with decrease in the effective length of the final focus electrode normalized by the lens-screen distance.

High resolution display capability is required for a color cathode ray tube in a high-definition display monitor for use in graphic terminals or the like capable of displaying a high-resolution image of drawings as well as letters or characters.

Therefore, for a color cathode ray tube having a useful diagonal phosphor screen dimension of 41 cm (17 inches) or more, it is desirable that a pith of dot-like electron beam apertures in its shadow mask is 0.28 mm or less, and the number of display dots in a horizontal direction on the phosphor screen is at least 1000, and this requires the diameter of electron beam spot at the center of the phosphor screen to be 0.5 mm or less.

For a color cathode ray tube employing the dark-tainted panel, of the first embodiment, to limit the diameter of the electron beam spot on the phosphor screen to 0.5 mm or a smaller value, the following relationship is derived from the line "a" in FIG. 2B, $$0.0625 \leqq \{B-20A/(3\phi)\}/L,$$

that is, $$0.0625L(mm) \leqq B-20A/(3\phi)\ (mm).$$

Incidentally, for the above-mentioned color cathode ray tube employing the tainted panel, previously proposed by the present inventors, to limit the diameter of the electron beam spot on the phosphor screen to 0.5 mm or a smaller value, the following relationship is derived from the line "b", in FIG. 2B, $$0.06 \leqq \{B-20A/(3\phi)\}/L,$$

that is, $$0.06L(mm) \leqq B-20A/(3\phi)\ (mm).$$

Color cathode ray tubes for use in monitors for information terminals and the like are required to have a large number of picture elements and to produce a high information content and large capacity display, and therefore it is desirable that dot aperture pitches in a shadow mask is not larger than 0.28 mm and the number of display dots in a horizontal direction on the phosphor screen is at least 1000 for a useful diagonal phosphor screen dimension not smaller than 41 cm (17 inches).

For ease of use of the information terminal display monitor on an ordinary office desk with a space sufficient for a keyboard and the like, the monitor needs to be made compact by making its depth as small as possible, and therefore it is desirable to make its useful diagonal screen dimension 51 cm (21 inches) and below.

In prior art cathode ray tubes having the maximum diagonal deflection angle of 90°, the lens-screen distances L are about 293 mm, about 326 mm, and about 355 mm for useful diagonal screen dimensions of 41 cm (17 inches), 46 cm (19 inches) and 51 cm (21 inches), respectively, and the ratio D/L of the diagonal screen dimension D to the lens-screen distance L is smaller than 1.45.

In cathode ray tubes having the maximum diagonal deflection angle of 100° to which the present invention is directed, the lens-screen distances L are about 258 mm, about 282 mm and about 314 mm for useful diagonal screen dimensions of 41 cm (17 inches), 46 cm (19 inches) and 51 cm (21 inches), respectively, and the ratio D/L of the diagonal screen dimension D to the lens-screen distance L is about 1.60.

The above values of the lens-screen distances L are selected such that interference of magnetic deflection fields leaking from the deflection yoke does not distort the shape of electron beam spots on the phosphor screen beyond an allowable limit and the anode-side end of the focus sub-electrode which forms a final stage of a main lens in cooperation with the anode is disposed as close to the phosphor screen as possible.

Although color cathode ray tubes having a maximum diagonal deflection angle of approximately 110° have been used for color TV receivers, it is difficult to employ a color cathode ray tube having the maximum deflection angle of approximately 110° deflection in an information terminal display requiring a dynamic focusing circuit for a high information content, large capacity and high resolution display because of the magnitude of the dynamic focus voltage limited by capacity of the circuit.

The color cathode ray tube of the present invention adopts a maximum diagonal deflection angle larger than 90° in order to make its axial length (an overall length) shorter than that of a conventional color cathode ray tube having a maximum diagonal deflection angle of 90°, while still keeping the maximum diagonal deflection angle less than 110° to reduce the magnitude of the dynamic voltage of the dynamic focus circuit in the information terminal display monitor. In this color cathode ray tube having a maximum diagonal deflection angle larger than 90°, but smaller than 110°, the ratio D/L of the diagonal phosphor screen dimension D to the lens-screen distance L is selected to be in a range of about 1.45 to about 1.70 such that the overall axial length of the cathode ray tube is made as short as possible, but such that the main lens of the electron gun is free from adverse effects of interference with leakage magnetic fields from the deflection yoke.

The range of 241 mm to 352 mm for the lens-screen distance L corresponds to the useful diagonal screen dimension of 41 cm (17 inches) to 51 cm (21 inches) of color cathode ray tubes.

In conclusion, the color cathode ray tube of the first embodiment can reduce the diameter of the electron beam spot on the phosphor screen to 0.5 mm or a smaller value by satisfying the following relationships even when the cathode ray tube employs a dark-tainted panel for the faceplate of the panel portion and a deflection yoke 8 for a relatively large deflection angle, 100°, for example, $$0.0625L(mm) \leqq B-20A/(3\phi) \leqq 22.0\ (mm),$$

and $$L \leqq 352\ (mm).$$

Figure 3:
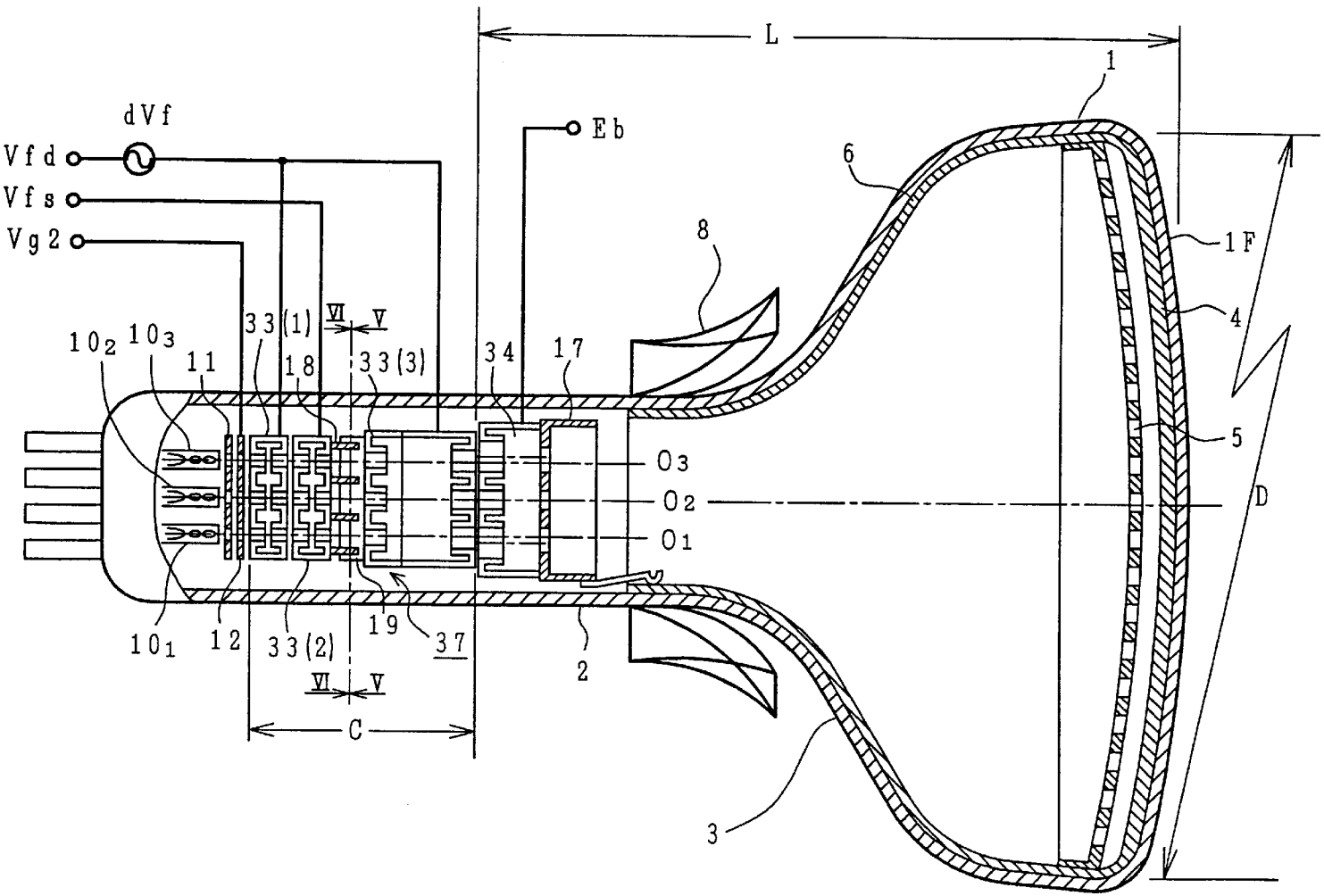
FIG. 3 is a horizontal cross-sectional view of a second embodiment of a color cathode ray tube in accordance with the present invention.
Figure 4:
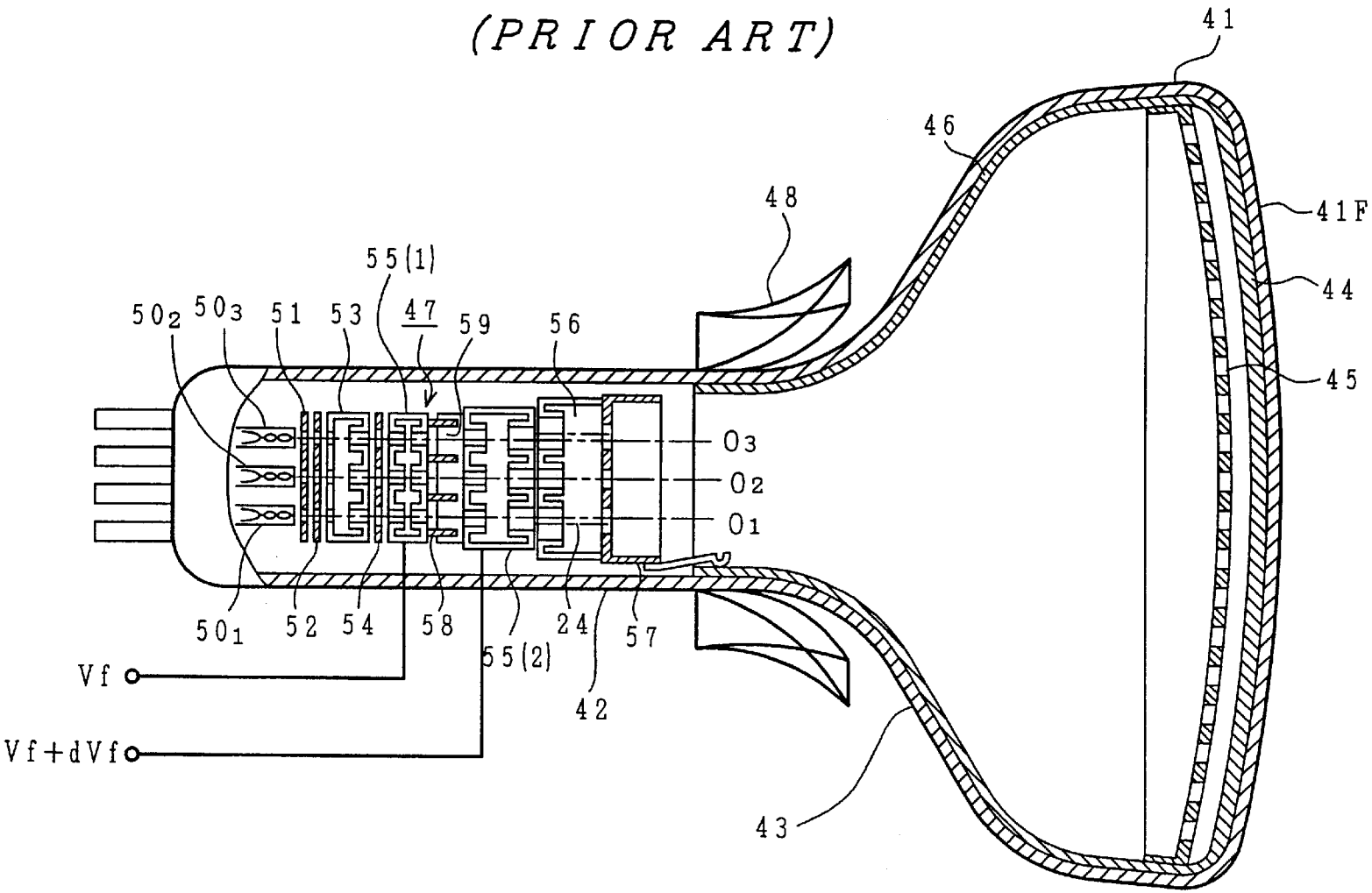
FIG. 4 (PRIOR ART)
FIG. 4 is a horizontal cross-sectional view of a color cathode ray tube employing a prior art dynamic focus type in-line electron gun.

FIG. 3 is a horizontal cross-sectional view of a second embodiment of a color cathode ray tube in accordance with the present invention.

In the DF type in-line electron gun 37 of FIG. 3, reference numeral $\mathbf{10}_1$ denotes a left-hand cathode, $\mathbf{10}_2$ is a center cathode, $\mathbf{10}_3$ is a right-hand cathode, 11 is the G1 electrode, 12 is the G2 electrode, 33(1) is a first G3 sub-electrode, 33(2) is a second G3 sub-electrode, 33(3) is a third G3 sub-electrode, 34 is the G4 electrode, 17 is the shield cup, 18 are the vertical electrode pieces and 19 are the horizontal electrode pieces.

The same reference numerals as utilized in FIG. 1 designate corresponding portions in FIG. 3.

The structure of the color cathode ray tube in the second embodiment may be substantially the same as in the first embodiment, except that, in the second embodiment, the means for focusing the electron beams from the electron generating means comprising the cathodes $\mathbf{10}_1$, $\mathbf{10}_2$, $\mathbf{10}_3$, the G1 electrode 11 and the G2 electrode 12 comprises the G3 sub-electrode 33(1), 33(2), 33(3), 33(4) and the G4 electrode 34.

The first to third G3 sub-electrodes 33(1) to 33(3), and the G4 electrode 34 in the second embodiment are identical in structure with the first to third G5 sub-electrodes 15(1) to 15(3), and the G6 electrode 16 in the first embodiment, respectively.

The second G3 sub-electrode 33(2) is provided with the vertical electrode pieces 18 sandwiching horizontally each of the three electron beam apertures in its end facing the third G3 sub-electrode 33(3), and the third G3 sub-electrode 33(3) is provided with a pair of the horizontal electrode pieces 19 sandwiching vertically the three electron beam apertures in common in its end facing the second G3 sub-electrode 33(2). The vertical electrode pieces 18 and the horizontal electrode pieces 19 form an electrostatic quadrupole lens between the second and third G3 sub-electrodes 33(2), 33(3).

The G1 electrode 11 is supplied with a voltage approximately equal to or near zero volt, the G2 electrode 12 is supplied with a relatively low voltage Vg2 of about 400 to about 1000 volts, the second G3 sub-electrode 33(2) is supplied with a fixed voltage Vfs of about 5 kV to about 10 kV, the first G3 sub-electrode 33(1) and the third G3 sub-electrode 33(3) are supplied with a focus voltage (Vfd+dVf ) which is a fixed voltage Vfd superposed with a dynamic voltage dVf varying with deflection of the electron beams, and the G4 electrode 34, the shield cup 17 and the internal conductive coating 6 are supplied with an accelerating voltage (an anode voltage) Eb.

The color cathode ray tube of this embodiment forms two curvature-of-the-image-field correction lenses between the first and second G3 sub-electrodes 33(1), 33(2) and between the third G3 sub-electrode 33(3) and the G4 electrode 34, and one electrostatic quadrupole lens between the second and third G3 sub-electrodes 33(2), 33(3) by applying the focus voltage (Vfd+dVf) containing the dynamic voltage dVf to the first and third G3 sub-electrodes 33(1), 33(3), and corrects astigmatism of an electron beam spot and curvature of the image field.

The color cathode ray tube of the second embodiment operates in the way similar to the first embodiment.

Therefore further explanation for the structure of the second embodiment is omitted.

In the second embodiment, the effective length of the final focus electrode adjacent to the anode is the length designated as "c", measured from the cathode-side end of the first G3 sub-electrode 33(1) to the phosphor-screen-side end of the third G3 sub-electrode 33(3). The cathode-side end of the first G3 sub-electrode 33(1) faces directly the accelerating electrode (the G2 electrode) 12 in the electron beam generating section, and the correction terms 20A/(3ϕ) considered in the first embodiment need not be considered in the second embodiment. The length "c" can be adopted for the effective length of a final focus electrode in FIGS. 2A and 2B. In this embodiment, the lens-screen distance L is a distance from a phosphor-screen-side end of the third G3 sub-electrode 33(3) to the center of the phosphor screen in FIG. 3. In this embodiment, it is necessary to satisfy the following relationships:

$$0.0625L(\text{mm}) \leqq C \leqq 22.0 \text{ mm},$$

and $$L \leqq 352 \text{ (mm)}.$$

The operation of the second embodiment is substantially the same as that of the first embodiment already described, the advantages provided by the second embodiment is substantially the same as those of the first embodiment already described, and therefore the explanation of the operation and the advantages of the second embodiment are omitted.

Figure 7:
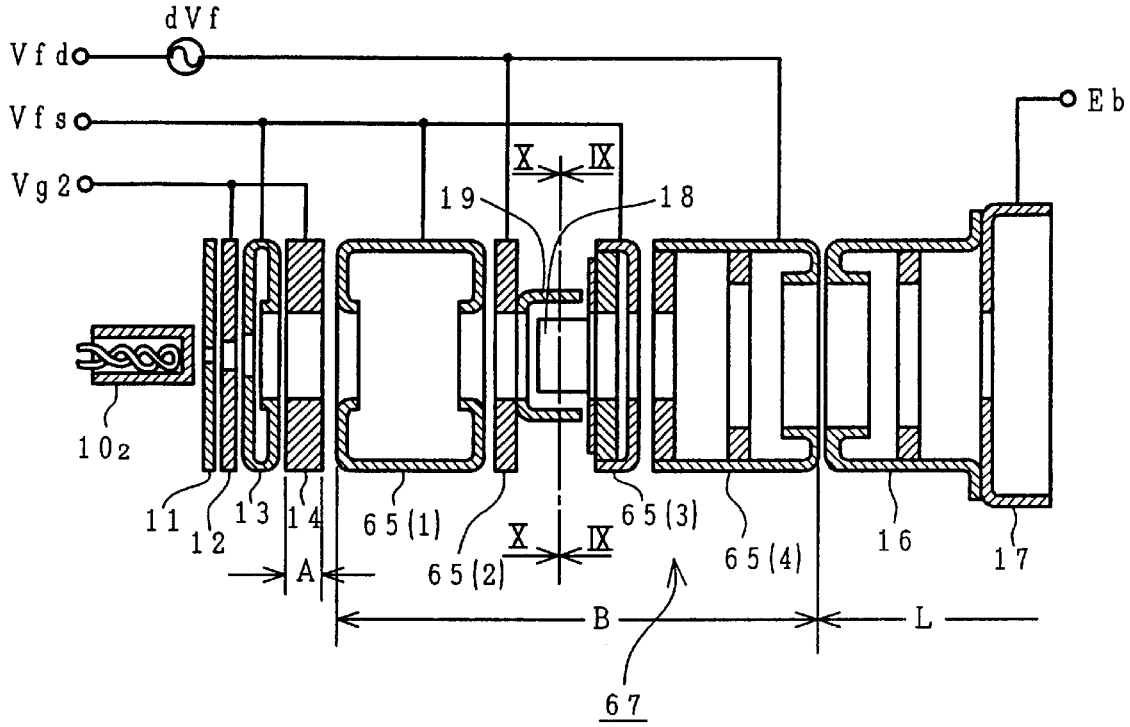
FIG. 7 is a vertical cross-sectional view of a third embodiment of a color cathode ray tube in accordance with the present invention.

FIG. 7 is a vertical cross-sectional view of a third embodiment of a color cathode ray tube in accordance with the present invention.

In the DF type in-line electron gun 67, reference numeral $\mathbf{10}_2$ denotes acenter cathode, 11 is the G1 electrode, 12 is the G2 electrode, 13 is the G3 electrode, 14 is the G4 electrode, 65(1) is a first G5 sub-electrode, 65(2) is a second G5 sub-electrode, 65(3) is a third G5 sub-electrode, 65(4) is a fourth G5 sub-electrode, 16 is the G6 electrode, 17 is a shield cup, 18 are vertical electrode pieces and 19 are horizontal electrode pieces.

Figure 9:
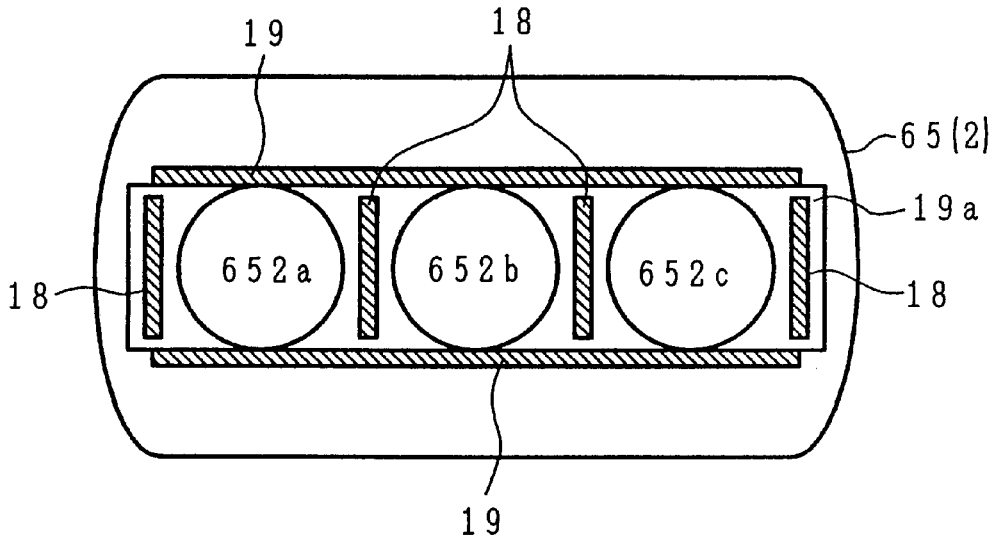
FIG. 9 is a cross-sectional view of a second G5 sub-electrode of FIG. 7 as viewed in the direction of arrows IX—IX in FIG. 7.
Figure 10:
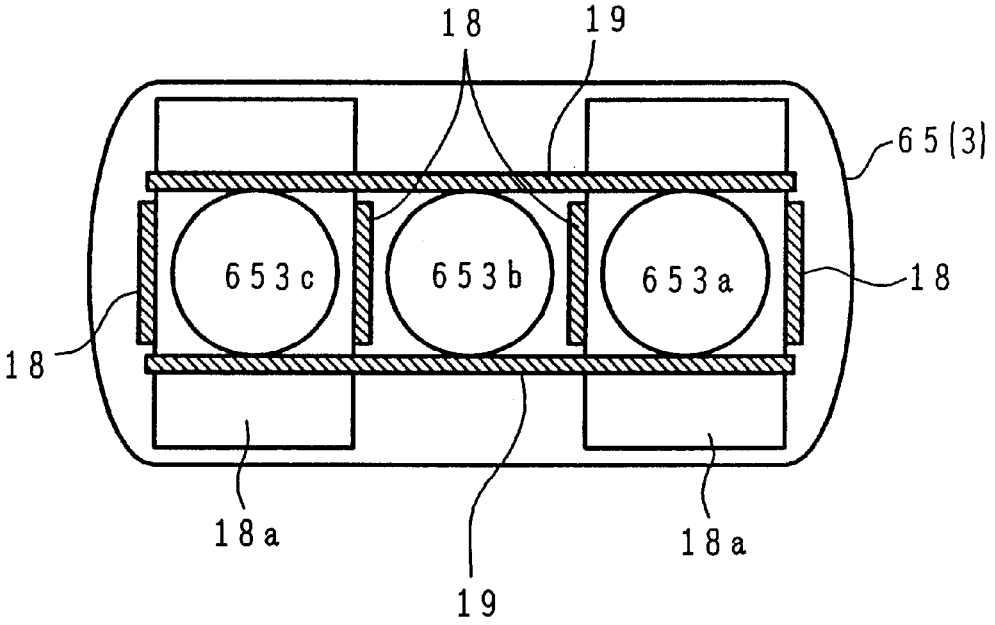
FIG. 10 is a cross-sectional view of a third G5 sub-electrode of FIG. 7 as viewed in the direction of arrows X—X in FIG. 7.

FIG. 9 is a cross-sectional view of the second G5 sub-electrode 65(2) of FIG. 7 as viewed in the direction of arrows IX—IX in FIG. 7, and FIG. 10 is a cross-sectional view of the third G5 sub-electrode 65(3) of FIG. 7 as viewed in the direction of arrows X—X in FIG. 7.

The second G5 sub-electrode 65(2) is provided with a pair of the horizontal electrode pieces 19 sandwiching vertically the three electron beam apertures 652*a*, 652*b*, 652*c* in common in its end facing the third G5 sub-electrode 65(3), and the third G5 sub-electrode 65(3) is provided with the vertical electrode pieces 18 sandwiching horizontally each of the three electron beam apertures 653*a*, 653*b*, 653*c* in its end facing the second G5 sub-electrode 65(2). The vertical electrode pieces 18 and the horizontal electrode pieces 19 form an electrostatic quadrupole lens between the second and third G5 sub-electrodes 65(2), 65(3).

The major difference between the first and third embodiments is that the vertical electrode pieces 18 and the horizontal electrode pieces 19 are interchanged.

The color cathode ray tube of the third embodiment forms three curvature-of-the-image-field correction lenses between the first and second G5 sub-electrodes 65(1), 65(2), between the third and fourth G5 sub-electrodes 65(3), 65(4) and between the fourth G5 sub-electrode 65(4) and the G6 electrode 16, and one electrostatic quadrupole lens between the second and third G5 sub-electrodes 65(2), 65(3) by applying the focus voltage (Vfd+dVf) containing the dynamic voltage dVf to the second and fourth G5 sub-electrodes 65(2), 65(4), and corrects astigmatism of an electron beam spot and curvature of the image field.

The color cathode ray tube of the third embodiment operates in the way similar to the first embodiment.

Figure 8:
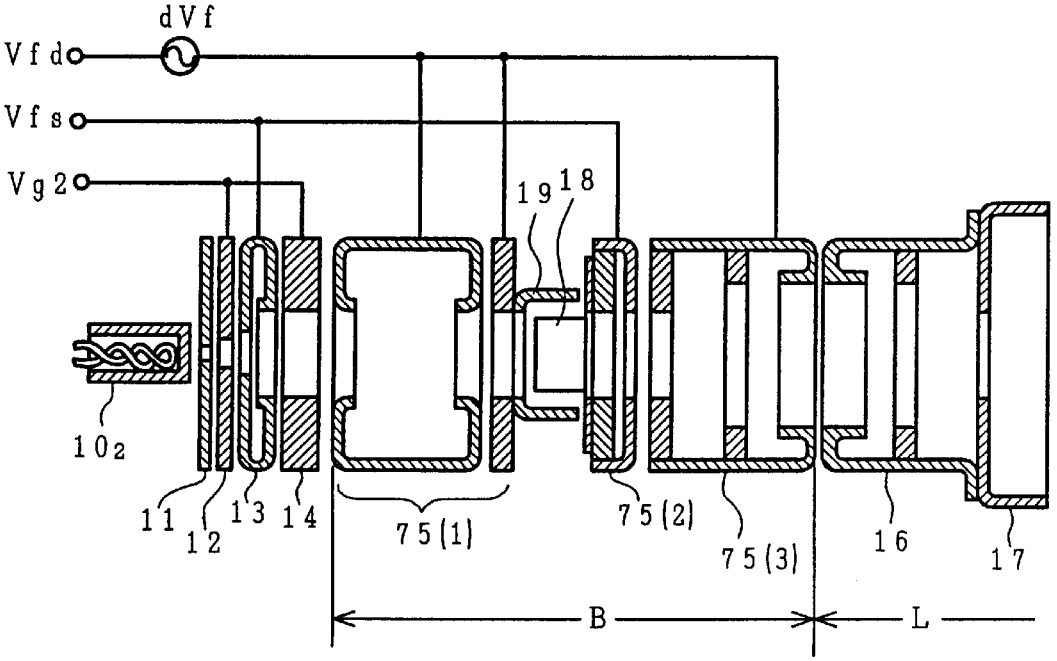
FIG. 8 is a vertical cross-sectional view of a fourth embodiment of a color cathode ray tube in accordance with the present invention.

FIG. 8 is a vertical cross-sectional view of a fourth embodiment of a color cathode ray tube in accordance with the present invention.

Except for the manner in which the respective electrodes are supplied with operating voltages, the electrodes are identical with those in the third embodiment. In this embodiment the G5 electrode is considered to be divided into three sub-electrodes including a first G5 sub-electrode 75(1), a second G5 sub-electrode 75(2) and a third G5 sub-electrode 75(3) because the first and second G5 sub-electrodes 65(1), 65(2) which are electrically isolated in the third embodiment are supplied with the same voltage Vfd in the fourth embodiment.

The color cathode ray tube of the fourth embodiment forms curvature-of-the-image-field correction lenses between the second and third G5 sub-electrodes 75(2), 75(3) and between the third G5 sub-electrode 75(3) and the G6 electrode 16, and one electrostatic quadrupole lens between the first and second G5 sub-electrodes 75(1), 75(2) by applying the focus voltage (Vfd+dVf) containing the dynamic voltage dVf to the first and second G5 sub-electrodes 75(1), 75(2), and corrects astigmatism of an electron beam spot and curvature of the image field.

The color cathode ray tube of the fourth embodiment operates in the way similar to the first embodiment.

As described above, the present invention provides the advantages of limiting the diameter of the electron beam spot on the phosphor screen to 0.5 mm or less, limiting the dynamic voltage to 650 volts or less and reducing appearance of raster moire even when a faceplate having a reduced light transmission and a wide-angle deflection yoke are employed, by forming a lens for correcting curvature of the image field and an electrostatic quadrupole lens with the final focus electrode adjacent to the anode and optimizing the length of the final focus electrode.

The number of the sub-electrodes into which a focus electrode adjacent to an anode is divided is three in the first, second and fourth embodiments, and four in the third embodiment, but the number of the sub-electrodes is not limited to these, and it depends upon the desired number of electrostatic quadrupole lenses and lens for correction of curvature of the image field. The electron gun of the present invention includes at least one of each of an electrostatic quadrupole lens and a lens for correction of curvature of the image field.

What is claimed is:

1. A color cathode ray tube comprising an evacuated envelope comprising a panel portion, a neck portion, a funnel portion for connecting said panel portion and said neck portion, a phosphor screen formed on an inner surface of a faceplate of said panel portion, an in-line type electron gun housed in said neck portion, and a deflection yoke mounted around said funnel portion;

said in-line type electron gun comprising an electron beam generating section having three in-line cathodes, a G1 electrode and a G2 electrode arranged in the order named for projecting three electron beams arranged approximately in parallel with each other in a horizontal plane toward said phosphor screen, and an electron beam focusing section comprising a G3 electrode, a G4 electrode, a G5 electrode and an anode arranged in the order named for focusing said three electron beams on said phosphor screen, wherein said G5 electrode comprises a plurality of sub-electrodes arranged to be supplied alternately with a first focus voltage and a second focus voltage, said first focus voltage being a first fixed voltage, said second focus voltage being a second fixed voltage superposed with a dynamic voltage varying with deflection of said three electron beams, at least one electrostatic quadrupole lens is formed between two of said plurality of sub-electrodes supplied alternately with said first focus voltage and said second focus voltage, at least one lens for correcting curvature of the image field is formed between two of said plurality of sub-electrodes supplied alternately with said first focus voltage and said second focus voltage, said G4 electrode, said G5 electrode and said phosphor screen satisfy following inequalities:

$$0.0625 \times L(\text{mm}) \leqq B - 20A/(3\phi) \leqq 22.0 \text{ mm},$$

and $$L(\text{mm}) \leqq 352 \text{ mm}$$

where A(mm) is an axial length of said G4 electrode, $\phi$(mm) is an average of horizontal and vertical diameters of an electron beam aperture for a center electron beam of said three electron beams in said G4 electrode, B(mm) is an axial length measured from a cathode side end of said G5 electrode to a phosphor screen side end of said G5 electrode, and L(mm) is an axial distance from said phosphor screen side end of said G5 electrode to a center of said phosphor screen.

2. A color cathode ray tube according to claim 1, wherein said second focus voltage is supplied to a group of said plurality of sub-electrodes including one nearest said anode.

3. A color cathode ray tube according to claim 1, wherein said deflection yoke is of the type having both horizontal and vertical deflection windings wound in a saddle configuration for a diagonal deflection angle in a range of 95° to 105°.

4. A color cathode ray tube according to claim 1, wherein said at least one electrostatic quadrupole lens is formed between second and third ones of said plurality of sub-electrodes counting from a side of said cathode.

5. A color cathode ray tube according to claim 1, wherein said plurality of sub-electrodes are at least three in number.

6. A color cathode ray tube according to claim 1, wherein said plurality of sub-electrodes are four in number.

7. A color cathode ray tube according to claim 1, wherein said first fixed voltage and said second fixed voltage are in a range of about 5 kV to about 10 kV, and said anode is supplied with a voltage in a range of about 20 kV to about 30 kV.

8. A color cathode ray tube according to claim 1, wherein a light transmission of said faceplate is about 38%.

9. A color cathode ray tube comprising an evacuated envelope comprising a panel portion, a neck portion, a funnel portion for connecting said panel portion and said neck portion, a phosphor screen formed on an inner surface of a faceplate of said panel portion, an in-line type electron gun housed in said neck portion, and a deflection yoke mounted around said funnel portion;

said in-line type electron gun comprising an electron beam generating section having three in-line cathodes, a G1 electrode and a G2 electrode arranged in the order named for projecting three electron beams arranged approximately in parallel with each other in a horizontal plane toward said phosphor screen, and an electron beam focusing section comprising a G3 electrode, and an anode arranged in the order named for focusing said three electron beams on said phosphor screen, wherein said G3 electrode comprises a plurality of sub-electrodes arranged to be supplied alternately with a first focus voltage and a second focus voltage, said first focus voltage being a first fixed voltage, said second focus voltage being a second fixed voltage superposed with a dynamic voltage varying with deflection of said three electron beams, at least one electrostatic quadrupole lens is formed between two of said plurality of sub-electrodes supplied alternately with said first focus voltage and said second focus voltage, at least one lens for correcting curvature of the image field is formed between two of said plurality of sub-electrodes supplied alternately with said first focus voltage and said second focus voltage, said G3 electrode and said phosphor screen satisfy following inequalities:

$$0.0625 \times LA(\text{mm}) \leqq C \leqq 22.0 \text{ mm}$$

$$LA(\text{mm}) \leqq 352 \text{ mm}$$

where C(mm) is an axial length measured from a cathode side end of said G3 electrode to a phosphor screen side end of said G3 electrode, and LA(mm) is an axial distance from said phosphor screen side end of said G3 electrode to a center of said phosphor screen.

10. A color cathode ray tube according to claim 9, wherein said second focus voltage is supplied to a group of said plurality of sub-electrodes including one nearest said anode.

11. A color cathode ray tube according to claim 9, wherein said deflection yoke is of the type having both horizontal and vertical deflection windings wound in a saddle configuration for a diagonal deflection angle in a range of 95° to 105°.

12. A color cathode ray tube according to claim 9, wherein said at least one electrostatic quadrupole lens is formed between second and third ones of said plurality of sub-electrodes counting from a side of said cathode.

13. A color cathode ray tube according to claim 9, wherein said plurality of sub-electrodes are at least three in number.

14. A color cathode ray tube according to claim 9, wherein said plurality of sub-electrodes are four in number.

15. A color cathode ray tube according to claim 9, wherein said first fixed voltage and said second fixed voltage are in a range of about 5 kV to about 10 kV, and said anode is supplied with a voltage in a range of about 20 kV to about 30 kV.

16. A color cathode ray tube according to claim 9, wherein a light transmission of said faceplate is about 38%.

* * * * *